US007096923B2

(12) United States Patent
Axelsson et al.

(10) Patent No.: US 7,096,923 B2
(45) Date of Patent: Aug. 29, 2006

(54) SEGMENT ROLL FOR CONTINUOUS CASTING MACHINES

(75) Inventors: Magnus Axelsson, Rönnäng (SE); Jens Bode, Dreieich (DE); Renato D'Uva, Turin (IT); Patrik Costa, Alvangen (SE); Filip Rosengren, Gothenburg (SE)

(73) Assignee: Aktiebolaget SKF, Göteborg (SE)

( * ) Notice: Subject to any disclaimer, the term of this patent is extended or adjusted under 35 U.S.C. 154(b) by 19 days.

(21) Appl. No.: 11/000,398

(22) Filed: Dec. 1, 2004

(65) Prior Publication Data

US 2005/0133190 A1 Jun. 23, 2005

(30) Foreign Application Priority Data

Dec. 2, 2003 (SE) ..... 0303241

(51) Int. Cl.
*B22D 11/12* (2006.01)

(52) U.S. Cl. ..... 164/448; 164/442

(58) Field of Classification Search ..... 164/448, 164/442, 480

See application file for complete search history.

(56) References Cited

U.S. PATENT DOCUMENTS 2,937,414 A * 5/1960 Cotchett ..... 19/295
4,351,383 A * 9/1982 Gladwin ..... 164/448
4,438,989 A * 3/1984 Negele et al. ..... 384/477
5,649,889 A 7/1997 Warner, III
6,484,793 B1 * 11/2002 Scheurecker ..... 164/448

FOREIGN PATENT DOCUMENTS

DE 42 27 987 2/1994
DE 102 02 525 7/2003

* cited by examiner

*Primary Examiner*—Kevin Kerns
*Assistant Examiner*—I.-H. Lin
(74) *Attorney, Agent, or Firm*—Buchanan Ingersoll & Rooney PC

(57) ABSTRACT

A segment roll for use in a continuous casting machine includes a number of roll segments axially spaced apart and supported in bearings on a non-rotating shaft. Each roll segment is a self-contained unit including a sleeve-shaped outer mantle, an internal sleeve disposed coaxially within the outer mantle, and a bearing assembly disposed radially between the outer mantle and the inner sleeve within an annular recess disposed at each end of the roll segment. Each bearing assembly is spaced from an inner envelope surface of the internal sleeve and includes a bearing and a seal, wherein the internal sleeve is in non-rotatable contact with the non-rotating sleeve.

6 Claims, 2 Drawing Sheets

SEGMENT ROLL FOR CONTINUOUS CASTING MACHINES

The present application claims priority under 35 U.S.C. § 119 to Patent Application Serial No. 0303241-1 filed in Sweden on Dec. 2, 2003.

BACKGROUND OF THE INVENTION

The present invention refers to a segment roll for use in a continuous casting machine.

In a continuous casting machine slabs of metal are continuously cast from molten metal, which is poured from a ladle down into a tundish, from which it is conveyed to a water-cooled mould, where the slab of continuous cast material begins to solidify. Thereafter the slab is continuously fed between two curved tracks, formed by a plurality of segmented rolls, which continue to shape and cool the slab to the final thickness of the cast material.

The segment roll for a continuous casting machine comprises conventionally a non-rotary shaft with a number of roll segments mounted thereon, and with bearings and sealing cassettes built into every roll segment. The inner rings of the bearings have been mounted directly upon the shaft, which means that it has been necessary to deliver the long roll with all the segments arranged on the shaft as otherwise the sealing cassettes and the bearings can fall off or be displaced during transport. As the segmented roll can have a length of more than two meters, the long and heavy rolls have required special transport facilities, when delivered from manufacturer to the site of the continuous casting machine. At assembly of these conventional rolls it is furthermore required large mounting forces and special tools for pushing up the roll segments with sealing cassettes and bearings on the shaft.

After mounting of the segments it is furthermore not sure that the lips of the sealing cassettes have not been bent away or if the shaft has been subjected to scratches or other damages, which in both cases could mean that the sealing function is lost.

OBJECTS AND SUMMARY OF INVENTION

One purpose of the present invention is to provide a new segment roll for a continuous casting machine, whereby the logistic problems experienced with the conventional solution are highly eliminated.

Another purpose of the present invention is to ascertain that the sealing effect is not lost during assembly of the segments on the roll shaft, and also that the bearings supporting the segments are not subjected to scratches or other damages during assembly.

Still another purpose of the present invention is to provide a segment roll for a continuous casting machine, wherein damaged segment s can be exchanged individually without the requirement to exchange the entire segment roll.

All these purposes have been fulfilled with the segment roll according to the present invention, by the fact that the segment roll comprises a number of roll segments which are axially spaced apart and supported in bearings on a non-rotating shaft. Each roll segment is a self-contained unit which includes a sleeve-shaped outer mantle, an internal sleeve disposed coaxially within the outer mantle, and a bearing assembly disposed radially between the outer mantle and the inner sleeve within an annular recess disposed at each end of the roll segment. Each bearing assembly is spaced from an inner envelope surface of the internal sleeve and includes a bearing and a seal, wherein the internal sleeve is in non-rotatable contact with the non-rotating shaft.

BRIEF DESCRIPTION OF DRAWINGS

Hereinafter the segment roll according to the present invention will be further described with reference to the accompanying drawings, showing a non-limiting embodiment thereof.

DETAILED DESCRIPTION OF A PREFERRED EMBODIMENT

Figure 1:
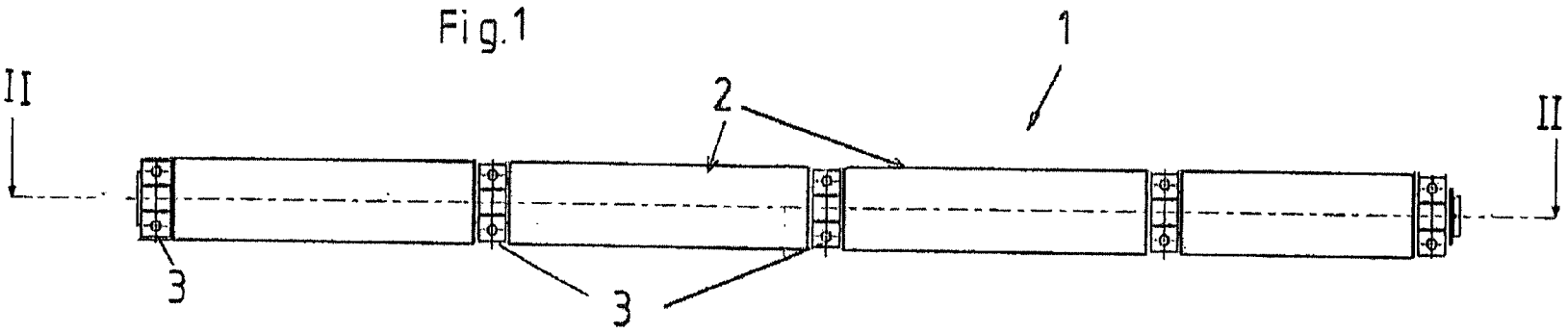
FIG. 1 shows in a top view a segment roll for a continuous casting machine in accordance with the present invention.

In FIG. 1 is shown in a top view a segment roll 1 according to the invention having four roll segments 2, which are spaced apart by means of supporting blocks 3, one supporting block 3 being positioned on each side of a roll segment 2.

Figure 2:
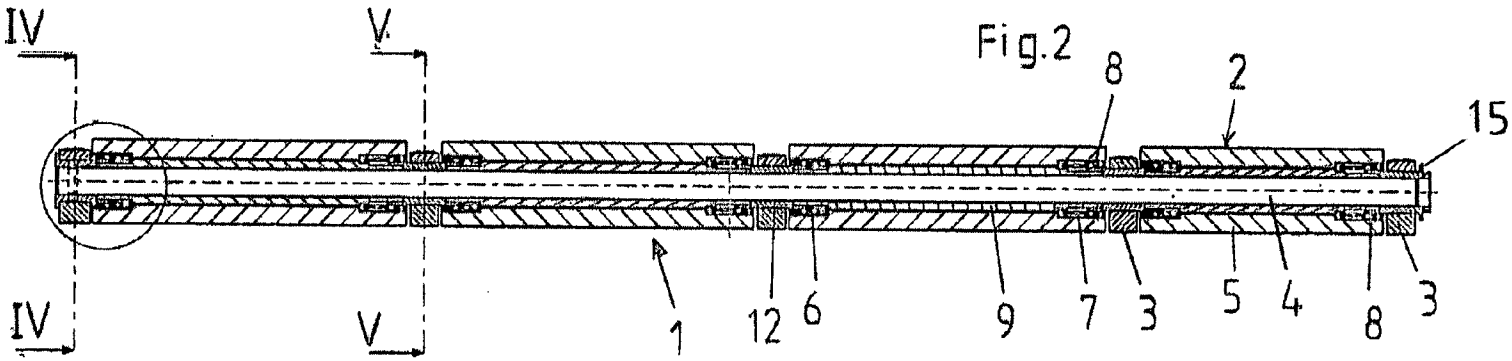
FIG. 2 is a section along line II—II in FIG. 1.

As can be seen in the cross section along line II—II shown in FIG. 2, the segment roll 1 incorporates a non-rotary shaft 4 and a number of roll segments 2 rotatably supported on the shaft 4. Each roll segment is constituted by a hollow substantially sleeve-shaped roll 5, which is supported in a locating bearing 6 and a non-locating bearing 7, which latter one can for instance be a toroidal roller bearing, giving non-locating properties for absorbing axial dimension changes caused by varying temperatures at the roll. The outer ends of each roll segment 2 are also provided with a sealing cassette 8 each, which sealing cassette can be anyone of a number of different sealing cassettes available on the market, and having an ability to prevent dirt and moisture from penetrating into the bearings.

A supporting block 3 is arranged on each side of each one of the roll segments 2 for supporting the shaft 4 in a non-rotatable manner. In the instance where two roll segments 2 are provided adjacent each other, the supporting block 3 provided between them of course can be common for the opposed ends of both the adjacent roll segments, such as shown.

So far the segment roll as described has substantially the same design as the earlier known segment rolls.

However the segment roll 1 according to the invention in contrast to the earlier known segment roll has not the bearings and sealing cassettes arranged directly upon the shaft, but every roll segment 2 has a hollow internal sleeve 9.

Each roll segment 2 has an annular internal recess 10 (see FIG. 7) in the axial ends of the roll 5 and each internal sleeve 9 has an outer annular recess 11 provided in the axial ends thereof. Each pair of these annular recesses 10, 11 are disposed radially opposite one another to form together a seat for the bearing assembly comprised of the bearing 6 or 7 and the sealing cassette 8. It is of course evident that the seat can be arranged by providing an annular recess in only one of the roll segment 2 and the internal sleeve 9.

Each roll segment 2 therefore constitutes an individual, separate unit incorporating roll 5, bearings 6, 7, two sealing cassettes 8 and inner sleeve 9, and each such unit can be mounted on the shaft in a comparatively simple manner, without the risk that the sealing components during the mounting can be damaged or flipped away from their sealing contact, and the risk for scratching or otherwise damaging the bearing during mounting of the roll segments on a shaft is also eliminated, as the mounting does not involve any direct contact between, on one hand, the bearings and seals and, on the other hand, the shaft. Such a roll segment incorporating roll 5, bearings 6, 7, sealing cassettes 8 and inner sleeve 9, thus forms a self-contained unit, which can contain its own amount of lubricant, whereby the unit is re-lubrication free.

At each one of the supporting blocks 3, there is also arranged a spacing sleeve 12 keeping adjacent roll segments 2 spaced apart axially by contacting the side faces of an inner ring element 8*a* of the sealing cassette 8. In the embodiment shown this spacing sleeve 12 is provided through a bore extending through the supporting block 3 thus that the spacing sleeve 12 is positioned between the shaft 4 and the bore of the supporting block 3, thereby also projecting axially out of the bore in the supporting block 3 to contact the end faces of the elements 8*a*.

There preferably remains a slight axial space between the spacing sleeves 12 and the inner sleeves 9. Preferably, the sleeve 9 is fitted by a friction-fit on the non-rotary shaft 4. The friction force between the sleeve 9 and the shaft 4 is greater than the friction in the bearing assembly, so the sleeve 9 will not rotate when the rolls 5 rotate.

Of course, the sleeve 9 could e mechanically fixed to the shaft 4, but an advantage results from employing only a frictional contact between the sleeve 9 and the shaft 4. That is, if one or more of the bearings should seize-up, the sleeve 9 will be caused to rotate slidingly on the shaft 4 until repair can be made, rather than breaking the mechanical connection which could involve more serious repairs.

Figure 3:
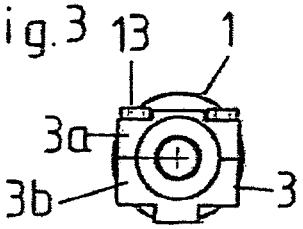
FIG. 3 is an end view as seen from the left hand side in FIG. 2.

In FIG. 3 is illustrated an end view of the segment roll 1 according to the invention and as seen from the left hand side in FIG. 1. As can be seen the supporting block 3 is made as a two-part split block, where the upper and lower half 3*a*, 3*b* are detachably connected by means of bolts 13.

Figure 4:
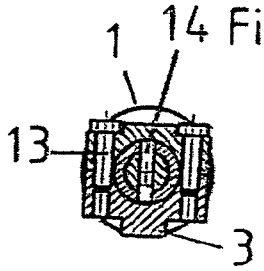
FIG. 4 is a cross section through a supporting block along line IV—IV in FIG. 2.

FIG. 4 is a section through the end supporting block 3 farthest to the left in FIG. 2 as seen along the line IV—IV in FIG. 2. In this supporting block there is also provided a bar 14 extending through the shaft 4 and thereby preventing the shaft from being carried along in the rotating motion of the s 5 of the roll segments.

Figure 5:
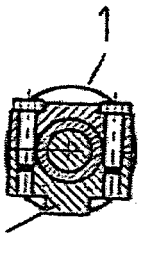
FIG. 5 is a cross section through a supporting block along line V—V in FIG. 2.

FIG. 5 is a section along line V—V in FIG. 2 through an intermediate supporting block 3, which is like the section shown in FIG. 4, except for the fact that there is no rotation-preventing bar provided in this intermediate supporting block.

Figure 6:
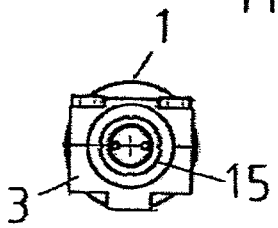
FIG. 6 is an end view as seen from the right hand side in FIG. 1.

FIG. 6 is an end view of the top segment roll 1 as seen from the right hand side in FIG. 1. At this end the shaft is secured by means of an adjustable lock nut 15.

Figure 7:
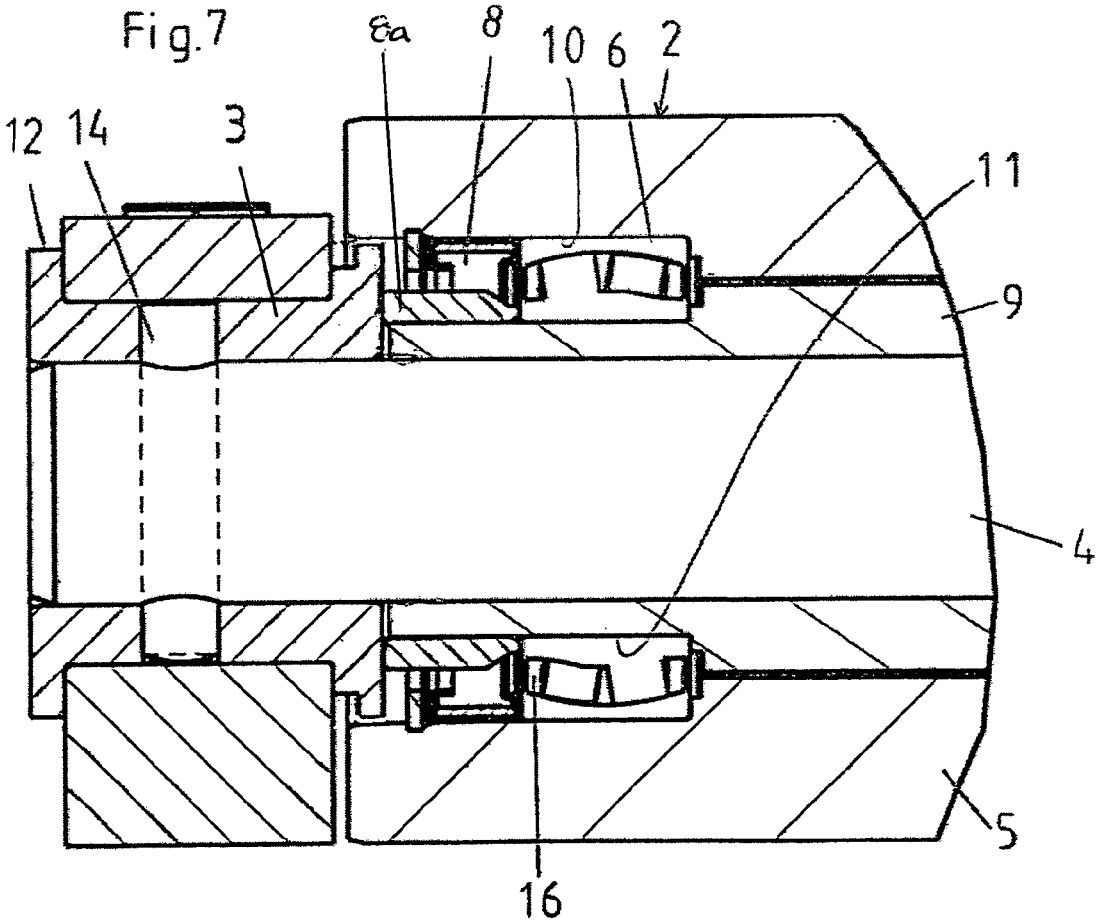
FIG. 7 is a portion in larger scale of the encircled portion in FIG. 2.

In FIG. 7 the locating bearing 6 is illustrated as a spherical roller bearing, but it is evident that other appropriate bearing types can be used. It can also be seen how the recessed space 10, 11 inside the sealing cassette 8, where the bearing 6 is contained also can be provided with a volume of lubricant 16, preferably grease, sufficient for permitting re-lubrication free operation of the segment roll.

The self-contained segment roll according to the invention is advantageous for several reasons, as it can be transported to the site where it shall be used with the roll segments separate from the shaft, whereas the roll segments and the shaft can be assembled on the site without risk for incorrect mounting, and this means in turn, that the transport can be carried through in ordinary, standardized cargo facilities. The encapsulated design furthermore allows itself to be lubricated for once, thereby avoiding re-lubrication and simplifying maintenance.

The invention is not limited to the embodiment shown in the drawings and described in connection thereto, but modifications and variants are possible without departing from the scope of invention as defined in the accompanying claims.

Although the segment roll 1 thus has been shown having four roll segments 2 supported on the shaft 4, it is evident that the segment roll 1 can have other numbers of roll segments. A segment roll of this type is in the art often referred to as a top segment roll, but due to the fact that it can be used in all positions of such a guiding track for a continuous casting machine it has hereinbefore been referred to only as a segment roll.

What is claimed is:

1. A segment roll for use in a continuous casting machine, and comprising a number of roll segments axially spaced apart and supported in bearings on a non-rotating shaft, each roll segment being a self-contained unit including a sleeve-shaped outer mantle, an internal sleeve disposed coaxially within the outer mantle, and a bearing assembly disposed radially between the outer mantle and the inner sleeve within an annular recess disposed at each end of the roll segment, each bearing assembly being spaced from an inner envelope surface of the internal sleeve and including a bearing and a seal, wherein the internal sleeve is in non-rotatable contact with the non-rotating shaft, wherein the bearing located at one end of at least one of the roll segments comprises a locating roller bearing, and the bearing located at an opposite end of the at least one roll segment comprises a non-locating roller bearing, the non-locating roller bearing comprising a toroidal roller bearing.

2. The segment roll according to claim 1, wherein the shaft is non-rotatably supported in a number of supporting blocks provided with respective spacing sleeves separating the individual roll segments axially from each other and from the supporting blocks.

3. The segment roll according to claim 2 wherein the shaft is secured against rotation by a rotation-preventing member interconnecting the shaft with at least one of the supporting blocks.

4. The segment roll according to claim 1 wherein a space disposed inside each sealing cassette is provided with a volume of lubricant for permitting re-lubrication-free operation of the segment roll.

5. The segment roll according to claim 1 wherein the annular recess at each end of each roll segment is formed by at least one of the outer and the internal sleeve.

6. The segment roll according to claim 1 wherein the internal sleeves are mounted by friction-fit on the non-rotating shaft, wherein the friction between the sleeves and the shaft is greater than friction in the bearings to resist rotation of the sleeves.

* * * * *